United States Patent [19]

Kolev

[11] Patent Number: 4,697,552

[45] Date of Patent: Oct. 6, 1987

[54] MODULAR INTERNAL COMBUSTION ENGINE

[75] Inventor: Nikola T. Kolev, Varna, Bulgaria

[73] Assignee: Naucho Proizvodsvena Laboratoria za Dvigateli s Vatreshno Gorene, Varna, Bulgaria

[21] Appl. No.: 802,466

[22] Filed: Nov. 27, 1985

[51] Int. Cl.[4] ..... F02B 75/24

[52] U.S. Cl. ..... 123/56 BC; 123/56 C

[58] Field of Search ..... 123/56 R, 56 A, 56 AC, 123/56 B, 56 BC, 56 C, 55 AA

[56] References Cited

U.S. PATENT DOCUMENTS

| | | | |
|---|---|---|---|
| 1,594,045 | 7/1926 | Caminez | 123/55 AA |
| 1,792,062 | 2/1931 | Barnum | 123/56 C |
| 1,810,688 | 6/1931 | Toce et al. | 123/56 BC |
| 3,584,610 | 6/1971 | Porter | 123/56 C |
| 3,604,402 | 9/1971 | Hatz | 123/56 C |
| 4,493,296 | 1/1985 | Williams | 123/56 C |

*Primary Examiner*—Craig R. Feinberg

[57] ABSTRACT

A modular internal combustion engine is disclosed, having a cross-shaped block-case, composed of a top cover with hatch and a bottom cover, in which there are formed two mutually perpendicular longitudinal and transverse cylindrical holes. In the longitudinal cylindrical hole there are fastened a top and a bottom shell, respectively, while in both ends, coaxially to the top and the bottom covers, there are fastened cylinders with water jackets and heads. In the longitudinal cavity, formed by the top and the bottom shell and the cylinders, there is disposed a composite piston, while on both sides of the composite piston, between the faces and the heads, there are disposed combustion chambers. In both ends of the composite piston there are disposed ball joints with self-adjusting rolls. Between the self-adjusting rolls and in the vertical slots of the composite piston and the external slots of the top and the bottom shell and the internal cavity of the block-case there is disposed a three-cornered cam, the shaft of which cam is seated in the transverse cylindrical hole.

5 Claims, 3 Drawing Figures

MODULAR INTERNAL COMBUSTION ENGINE

This invention concerns internal combustion engines in general, and more particularly, those which can be used for stationary installation or for installation on transport vehicles, such as e.g. on ships.

In the known internal combustion engine disclosed in French Pat. No. 1,381,957, a three-cornered cam is mated with rolls seated on axles, which are fastened to both ends of a frame enveloping the shaft of the three-cornered cam. Each end of the frame terminates with a rod. Two pistons, which are fastened to the heads of the rods, slide in cylinders. The cylinders are fastened to a cylinder block in which the three-cornered cam rotates.

The disadvantages of this engine include the complex design of the piston unit and the complex mating with the three-cornered cam; the great overall dimensions and the great mass; and the fact that the cylinders are loaded by a normal force, which therefore leads to increased losses due to friction.

In another known internal combustion engine described in U.S. Pat. No. 3,482,554, the three-cornered cam replaces the crank of a V-engine, with the pistons then connected by means of rods to a roll, which rolls over the profile of the cam. This takes place while the roll is pressed against the cam by means of a special mechanism.

The disadvantages of this engine include its great mass, its great overall dimensions and its complex design. Moreover, normal forces are produced, and also a change during prolonged operation in the conditions of work of the mechanism employed for pressing the roll against the profile of the cam.

SUMMARY OF THE INVENTION

It is therefore the general object of this invention to develop a modular internal combustion engine, featuring simple design, reduced mass and small overall dimensions, in which engine the friction between the piston and the cylinders is reduced and the efficiency is thereby increased.

This object is achieved according to the present invention by the development of a modular internal combustion engine which possesses a cross-shaped block-case, composed of a top cover with hatch and a bottom cover, in which there are shaped two mutually perpendicular longitudinal and transverse cylindrical holes. In the longitudinal cylindrical hole there are fastened a top and a bottom shell, respectively, while in both ends, coaxially to the top and the bottom covers, there are fastened cylinders with water jackets and heads. In the longitudinal cavity, formed by the top and the bottom shell and the cylinders, there is disposed a composite piston, while on both sides of the composite piston, between the faces and the heads, there are disposed combustion chambers. In both ends of the composite piston there are disposed ball joints with self-adjusting rolls.

Disposed between the self-adjusting rolls, and in the vertical slots of the composite piston and the external slots of the top shell and the bottom shell, and in the internal cavity of the block-casing, there is a three-cornered cam, the shaft of which cam is seated in the transverse cylindrical hole.

The advantages of the modular internal combustion engine according to the present invention lie in its simple design, its small overall dimensions and mass, the improved efficiency, the adaptability to manufacturing and repair, and the possibility of connecting several modules in series with full interchangeability.

BRIEF DESCRIPTION OF THE DRAWINGS

For a better understanding of the invention, reference should be made to the accompanying drawings in which there is illustrated and described a preferred embodiment of the invention.

DETAILED DESCRIPTION OF THE DRAWINGS

Figure 1:
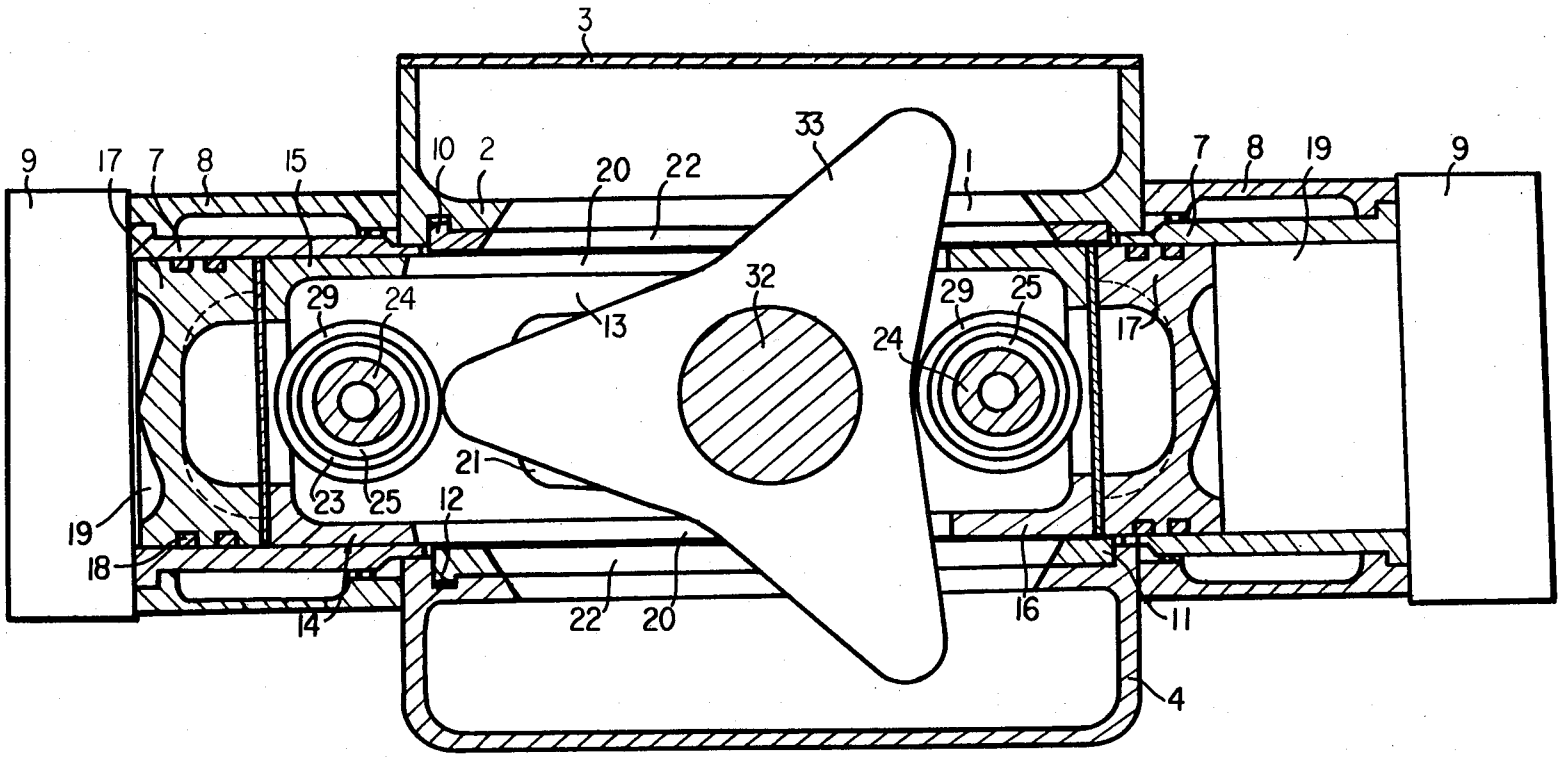
FIG. 1 is a longitudinal sectional view through the modular internal combustion engine according to the present invention.
Figure 2:
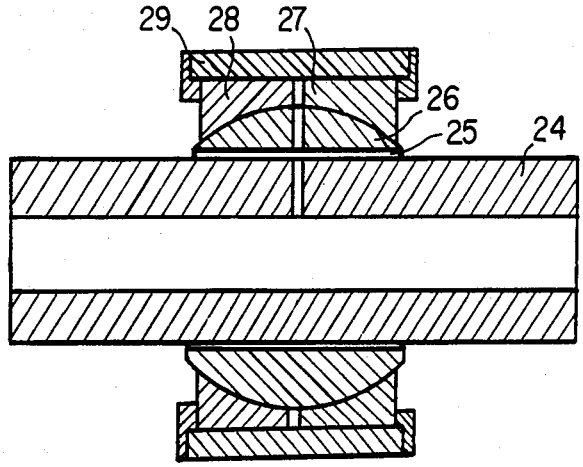
FIG. 2 is a sectional view of the ball joint of the modular internal combustion engine.

The modular internal combustion engine, according to the invention, includes a cross-shaped block-case 1, as seen in FIG. 1, which is made of a top cover 2 with hatch 3 and a bottom cover 4, these forming two mutually perpendicular longitudinal 5 and transverse 6 cylindrical holes, the axes of which holes lie in one plane. On both sides of the top cover 2 and the bottom cover 4, along the longitudinal cylindrical hole 5, there are fastened cylinders 7 with water jackets 8 and heads 9. Fastened to the top cover 2 and the bottom cover 4 are, respectively, a top shell 10 and a bottom shell 11. In one end of the block case 1, the top shell 10 and the bottom shell 11 have a step 12 for avoiding axial displacement of the shells. In the longitudinal cylindrical cavity 13, formed by the top shell 10, the bottom shell 11 and the cylinders 7, there is disposed a composite piston 14, which is made up by a top body 15, a bottom body 16 and faces 17 with grooves for sealing segments 18, arranged on both slides of the piston. Between the faces 17, the cylinders 7 and the heads 9 there are disposed the combustion chambers 19. Vertical slot 20 and horizontal slot 21 are formed in the composite piston 14. External slots 22 are formed in the top cover 2, the bottom cover 4, the top shell 10 and the bottom shell 11. In both ends of the composite piston 14 there are mounted ball joints 23, each made up by axles 24, as seen in FIG. 2, on which there are arranged first bearing bushes 25, and then, on the bearing bushes, bushes with external ball surface 26. On the bushes with external ball surface 26 there are arranged right ball segments 27 and left ball segments 28, and then on the ball segments, self-adjusting rolls 29.

Figure 3:
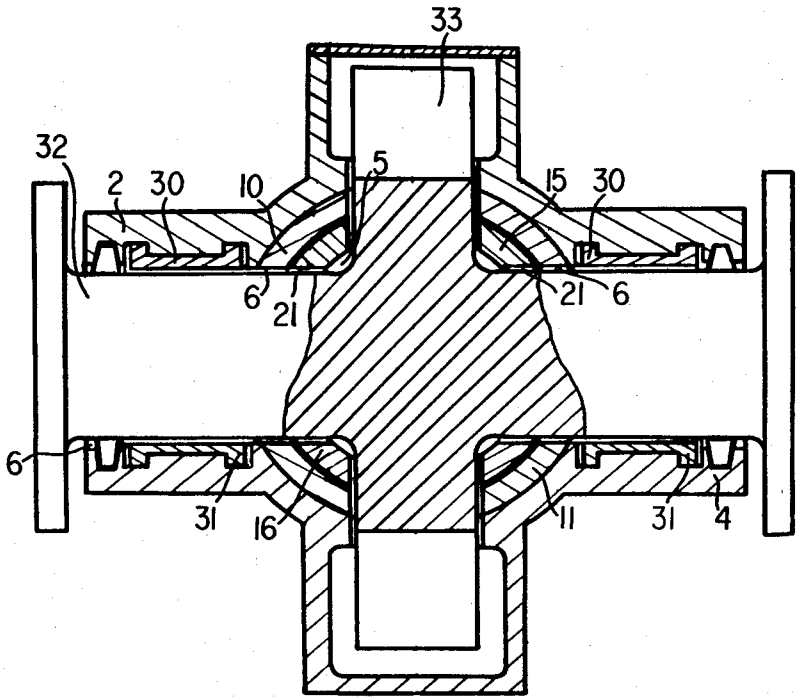
FIG. 3 is a transverse sectional view through the modular internal combustion engine.

In the transverse cylindrical hole 6 there are mounted top bearing shells 30 and bottom bearing shells 31, as seen in FIG. 3, in which is seated the shaft 32 of the three-cornered cam 33. The three-cornered cam 33 is also disposed in the vertical slot 20, the horizontal slot 21 and the external slot 22, geometrically mated with the self-adjusting rolls 29.

The modular internal combustion engine described immediately above is a modular unit with definite power characteristics. It is possible to obtain a composite internal combustion engine of the required power by the repeated connection of several modules.

The modular internal combustion engine according to the present invention operates as follows:

When the fuel in cylinder 7 is ignited, work is thereby effected. Under the action of the hot gases on the face 17, the composite piston 14 moves translationally by sliding along the top 10 and the bottom 11 shells. The self-adjusting roll 29 presses a force against the profile of the three-cornered cam 33, which force is applied perpendicular to the supporting surface, this producing a torque of the cam shaft 32 and loading the top bearing shell 30 and the bottom bearing shell 31. The reaction of the force on the composite piston 14 is taken up by the blockcase 1. The expansion of the gases on the one side of the composite piston 14 effects a compression of the air at its opposite side, with the energy for the compression being transmitted directly and without loss.

During one rotation of the shaft 32 of the three-cornered cam 33 there are effected approximately three work processes on both sides of the composite piston 14, or on the whole, six work processes.

A uniformity of the torque is achieved by the successive connection of several modules in one composite internal combustion engine, the torque being greater depending upon the number of modules.

Although the invention is described and illustrated with reference to a plurality of embodiments thereof, it is to be expressly understood that it is in no way limited to the disclosure of such preferred embodiments, but is capable of numerous modifications within the scope of the appended claims.

We claim:

1. A modular internal combustion engine, comprising a three-cornered cam with shaft, enveloped by two self-adjusting ball joint rolls, disposed at two opposite ends of a double-acting composite piston having cylinders with an internal surface and having water jackets and cylinder heads, wherein the double-acting piston consists of a top body and a bottom body which are interconnected and form a body of the composite piston; said composite piston defining midway oppositely facing vertical slots between the two ends thereof; at the two ends of the body of said composite piston there being fixed faces, and adjacent the two ends of the piston there are axles with bushes with an external spherical ball surface sliding thereon; on said bushes with said external ball surface there are arranged a right concave ball segment and a left concave ball segment, and on each of the right and left ball segments there is disposed thereabout one of said self-adjusting rolls; the body of said composite piston is placed in a bearing hole of a top shell and a bottom shell with a joint for motion; the body of the composite piston sliding on a bearing metal surface of said shells and, and only sealing rings rub against the surface of the cylinders, wherein the surface of said shells get lubricated under pressure and said shells press against walls of a surrounding block case having a transverse cylindrical hole therethrough, said block case consisting of a top cover and a bottom cover, and said covers are fixed against axial displacement by a step disposed in a groove of the block case; said shaft of said three-cornered cam being seated in said transverse cylindrical hole and extending through said vertical slots.

2. The modular internal combustion engine according to claim 1, wherein said top shell and said bottom shell each define a step for avoiding axial displacement relative to said top cover and said bottom cover.

3. The modular internal combustion engine according to claim 1, wherein said piston faces display grooves for sealing segments where said faces contact said cylinders.

4. The modular internal combustion engine according to claim 1, wherein said composite piston further defines, between ends thereof, a horizontal slot.

5. The modular internal combustion engine according to claim 1, further comprising a top bearing shell and a bottom bearing shell, mounted in said transverse cylindrical hole, said top bearing shell resting inside said top cover and said bottom bearing shell resting inside said bottom cover, said shaft of said three-cornered cam being seated between said top bearing shell and said bottom bearing shell.

* * * * *